US005914999A

United States Patent [19]

Beyerlein et al.

[11] Patent Number: 5,914,999

[45] Date of Patent: Jun. 22, 1999

[54] HIGH-FREQUENCY VOLTAGE GENERATOR FOR SUPPLYING AN X-RAY TUBE

[75] Inventors: Walter Beyerlein, Bubenreuth; Joerg Dorn, Altendorf; Werner Kuehnel, Uttenreuth, all of Germany

[73] Assignee: Siemens Aktiengesellschaft, Munich, Germany

[21] Appl. No.: 08/963,888

[22] Filed: Nov. 4, 1997

[30] Foreign Application Priority Data

Nov. 4, 1996 [DE] Germany ..... 196 45 418

[51] Int. Cl.[6] ..... H05G 1/10

[52] U.S. Cl. ..... 378/105; 378/101; 378/110

[58] Field of Search ..... 378/101, 105, 378/106, 109, 110

[56] References Cited

U.S. PATENT DOCUMENTS 4,439,869 3/1984 Hermeyer et al. ..... 378/101

*Primary Examiner*—Craig E. Church
*Attorney, Agent, or Firm*—Hill & Simpson

[57] ABSTRACT

An arbitrary voltage distribution can be achieved in a high-voltage generator which supplied an X-ray tube having a metallic central part, wherein the anode voltage and the cathode voltage are generated in the high-voltage generator by two series-connected high-voltage rectifiers with respective preceding high-voltage transformers, whereby the high-voltage transformers being supplied by an inverse rectifier. A clocked switch, via which the average value of the anode current can be set and matched to the cathode current, lies in the lead to the high-voltage transformer at the anode side.

5 Claims, 2 Drawing Sheets

DELAY STAGE
PLIP-PLOP
SEMICON-DUCTOR SWITCH
HIGHT-VOLTAGE RECTIFIER
HIGH-VOLTAGE TRANSFORMERS
HIGH-VOLTAGE RECTIFIER
X-RAY TUBE
INVERSE RECTIFIER
$I_A$
$U_A$
$U_K$
$I_K$
1
2
3
4
5
6
7
8
10
11
12
13

CLOCKED SWITCH
HIGHT-VOLTAGE RECTIFIER
HIGH-VOLTAGE TRANSFORMERS
HIGH-VOLTAGE RECTIFIER
X-RAY TUBE
INVERSE RECTIFIER
$I_A$
$U_A$
$U_K$
$I_K$
1
2
3
4
5
6
7
8
9

HIGH-FREQUENCY VOLTAGE GENERATOR FOR SUPPLYING AN X-RAY TUBE

BACKGROUND OF THE INVENTION

1. Field of the Invention

The present invention is directed to a high-voltage source for supplying an X-ray tube, and in particular to a high-frequency voltage generator for supplying an X-ray tube of the type having a grounded, metallic central part.

2. Description of the Prior Art

A high-frequency voltage generator is known that supplies an X-ray tube of the type having a grounded metallic central part disposed between the anode and the cathode. The cathode current is thereby unequal to the anode current since a part of the current flows off via the grounded metal central part. Since the positive side of the high-voltage supply is loaded less than the negative side, an asymmetrical voltage division, with a higher anode voltage, is obtained. A shift of the mid-point of the high-voltage thus occurs due to the asymmetrical voltage division.

SUMMARY OF THE INVENTION

An object of the present invention is to provide a high-frequency voltage generator for supplying an X-ray tube having a metallic central part such that the aforementioned shift of the mid-point of the high-voltage is avoided or can be arbitrarily set.

This object is inventively achieved in a high-voltage generator having two high-voltage transformers respectively connected with two following high-voltage rectifiers, whose junction lies at ground, the two high-voltage transformers being supplied from a common inverse rectifier and a switch that lies in the lead of the high-voltage transformer of the anode side. The switch is clocked such that the average value of the anode current is matched to that of the cathode current. The switch can be fashioned as a transductor or as a semiconductor switch.

DESCRIPTION OF THE PREFERRED EMBODIMENTS

Figure 2:
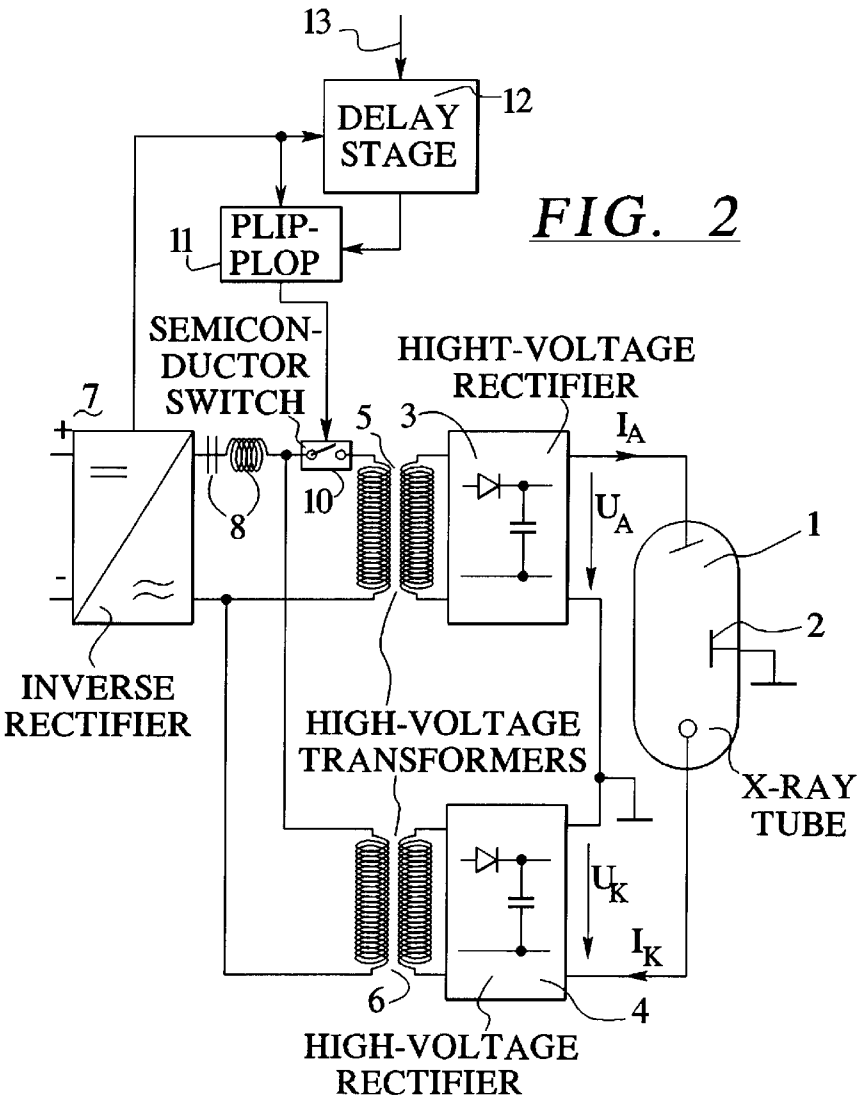
FIG. 2 is a schematic block diagram of a second embodiment of a high-frequency voltage generator, connected to an X-ray tube, constructed in accordance with the principles of the present invention.
Figure 1:
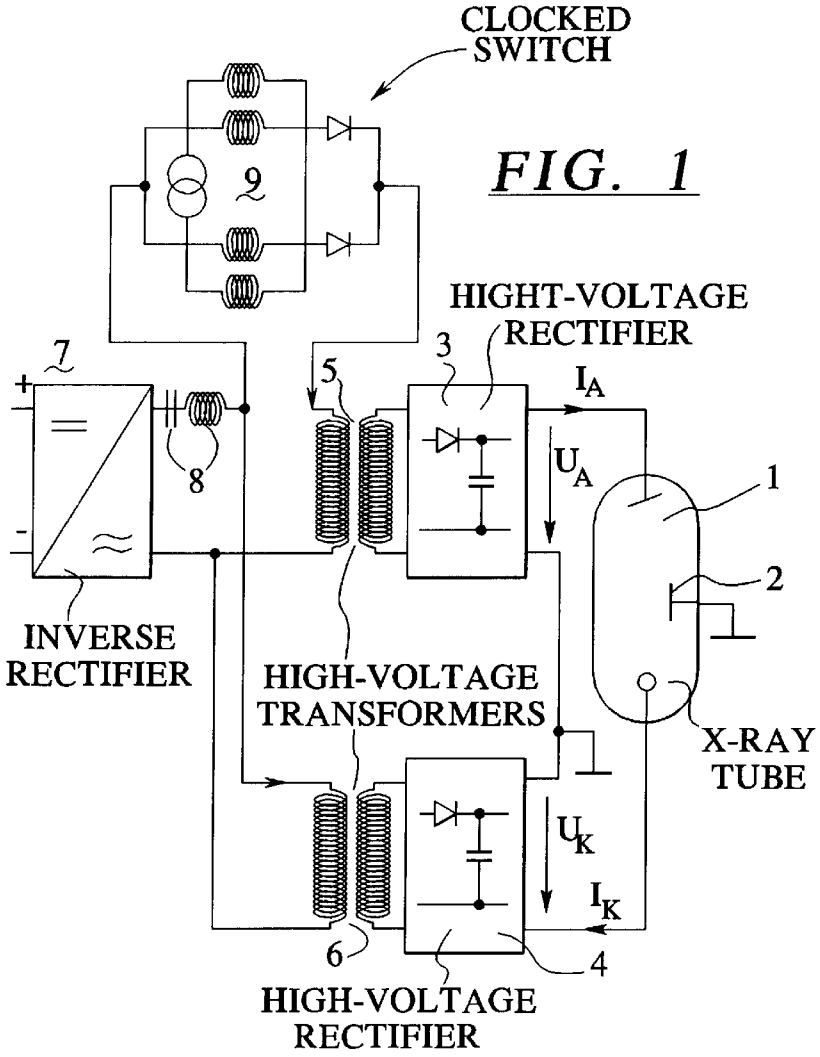
FIG. 1 is a schematic block diagram of a first embodiment of a high-frequency voltage generator, connected, to an X-ray tube, constructed in accordance with the principles of the present invention.
Figure 3:
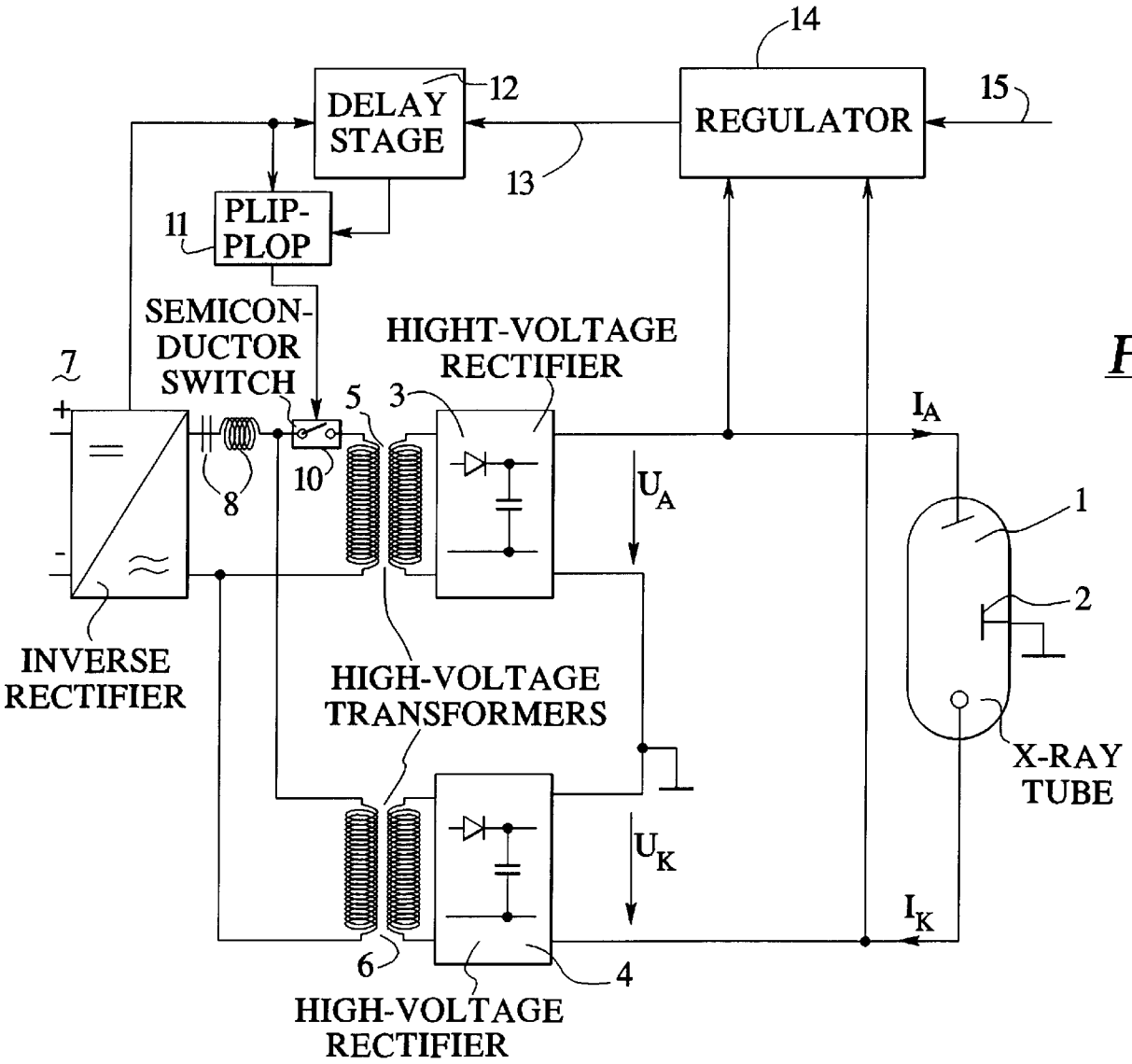
FIG. 3 is a schematic block diagram of a third embodiment of a high-frequency voltage generator, connected to an X-ray tube, constructed in accordance with the principles of the present invention.

FIGS. 1, 2 and 3 show an X-ray tube 1 with metallic central part 2 that lies at ground and whose overall voltage is supplied by two high-voltage rectifiers 3 and 4 that are connected in series and whose junction lies at ground. The high-voltage rectifier 3 supplies the voltage $U_A$ (anode voltage), i.e. the voltage between the anode and the metallic central part 2, and the high-voltage rectifier 4 supplies the voltage $U_K$ (cathode voltage), i.e. the voltage between the metallic central part 2 and the cathode of the X-ray tube 1. The high-voltage rectifiers 3 and 4 each contain filter sections and are respectively supplied by two high-voltage transformers 5 and 6 that are connected to a common inverse rectifier 7. The inverse rectifier 7 can be supplied from the three-phase mains via a three-phase rectifier. An LC transmission element 8 is connected to the output of the inverse rectifier 7.

A switch that can be clocked and that is fashioned as a transductor 9 lies in the lead between the inverse rectifier 7 and the high-voltage transformer 5. As a result, the average value of the anode current $I_A$ can be set and matched to the anode current $I_K$.

In the exemplary embodiment according to FIG. 2, a semiconductor switch 10 that can be formed by a power semiconductor and can be driven by a flip-flop 11 is provided for clocking the anode current $I_A$. The flip-flop 11 is in turn driven by the inverse rectifier 7 and by a delay stage 12. The delay stage 12 effects the closing of the semiconductor switch 10 and the output signal of the inverse rectifier effects the opening. The manipulated variable for the desired average value of the anode current $I_A$ is supplied to the delay stage 12 at the input 13.

In the exemplary embodiment according to FIGS. 1 and 2, the ratio of anode to cathode voltage can be set to arbitrary values, such as to equality in the specific instance. This ensues in a load-dependently controlled manner with a fixed clock pattern.

In the exemplary embodiment according to FIG. 3, the ratio of anode voltage to cathode voltage can likewise be set to arbitrary values, such as to equality in the specific instance. The clock pattern provided therefor is determined via a regulator 14 from the comparison of the ratio of anode to cathode voltage to a reference value at the reference value input 15 of the regulator 14.

Although modifications and changes may be suggested by those skilled in the art, it is the intention of the inventors to embody within the patent warranted hereon all changes and modifications as reasonably and properly come within the scope of their contribution to the art.

We claim as our invention:

1. A high-frequency voltage generator for supplying an X-ray tube having an anode and a cathode and a grounded, metallic central part disposed between the anode and the cathode, said voltage generator comprising:

a first high-voltage rectifier for producing an anode voltage relative to ground;

a second high-voltage rectifier for producing a cathode voltage relative to ground;

first and second high-voltage transformers respectively connected to and preceding and supplying said first and second high-voltage rectifiers;

an inverse rectifier connected to each of said first and second high-voltage transformers, including a line connecting said inverse rectifier to said first high-voltage transformer;

a clocked switch connected in said line between said inverse rectifier and said first high-voltage transformer; and means for clocking said clocked switch with a clock pattern for producing a selected anode current associated with said anode voltage.

2. A voltage generator as claimed in claim 1 wherein said clocked switch comprises a transductor.

3. A voltage generator as claimed in claim 1 wherein said clocked switch comprises a power semiconductor and wherein said means for clocking said clocked switch comprises a flip-flop.

4. A voltage generator as claimed in claim 1 wherein said means for clocking said clocked switch comprises means for clocking said clocked switch with a load-dependently controlled fixed clock pattern for producing a selected ratio of said anode voltage to said cathode voltage.

5. A voltage generator as claimed in claim 1 wherein said means for clocking said clocked switch comprises means for comparing a ratio of said anode voltage to said cathode voltage to a reference value for producing a clock pattern for setting said ratio to a selected value.

* * * * *